US007243520B2

(12) United States Patent
Woulds

(10) Patent No.: US 7,243,520 B2
(45) Date of Patent: Jul. 17, 2007

(54) STRIPPING ASSEMBLY

(75) Inventor: William Woulds, Shipley (GB)
(73) Assignee: Crown Packaging Technology, Inc., Alsip, IL (US)

( * ) Notice: Subject to any disclaimer, the term of this patent is extended or adjusted under 35 U.S.C. 154(b) by 9 days.

(21) Appl. No.: 10/565,502

(22) PCT Filed: Jun. 23, 2004

(86) PCT No.: PCT/EP2004/006788

§ 371 (c)(1),
(2), (4) Date: Jan. 23, 2006

(87) PCT Pub. No.: WO2005/014197

PCT Pub. Date: Feb. 17, 2005

(65) Prior Publication Data

US 2006/0174676 A1 Aug. 10, 2006

(30) Foreign Application Priority Data

Jul. 23, 2003 (EP) ..... 03255213

(51) Int. Cl.
*B21D 45/06* (2006.01)

(52) U.S. Cl. ..... 72/344; 72/345
(58) Field of Classification Search ..... 72/344, 72/345
See application file for complete search history.

(56) References Cited

U.S. PATENT DOCUMENTS

| | | | |
|---|---|---|---|
| 4,121,447 | A | 10/1978 | Sniady |
| 4,606,215 | A | 8/1986 | McMillin |
| 5,115,662 | A | 5/1992 | Relich et al. |

FOREIGN PATENT DOCUMENTS

| | | |
|---|---|---|
| GB | 2 181 685 A | 4/1987 |
| JP | 2003103312 | 4/2003 |

*Primary Examiner*—Lowell A. Larson
*Assistant Examiner*—Debra Wolfe
(74) *Attorney, Agent, or Firm*—Diller, Ramik & Wight

(57) ABSTRACT

A stripping assembly for removal of a can body from a punch in a can bodymaker in which an actuator lifts stripper fingers clear of the can carried on the punch in the forward stroke to avoid damage to the can or can coating. On the return stroke, the actuator piston is disabled so that the fingers close around the punch for stripping the can from the punch.

8 Claims, 3 Drawing Sheets

STRIPPING ASSEMBLY

BACKGROUND OF THE INVENTION

This invention relates to a stripping assembly. In particular, it relates to a stripper for removal of a tubular article, such as a can body, from a close-fitting mandrel on which the article is carried, for example for forming.

Stripping devices are in general use for stripping thin-walled cans from a punch or ram on which such cans have been formed in a "draw and wall-ironing" ("DWI") process. These strippers typically comprise an annulus of stripping fingers. The annulus is situated within a die assembly such that radially inward ends of the fingers extend into the bore of the assembly through which the punch passes during the DWI process.

The stripper fingers are biased inwardly so that on the forward, can forming, stroke of the punch, the can formed and carried on the punch deflects the stripping fingers against the biasing force as the can moves along the bore through the fingers. After the can has moved axially beyond the fingers, the biasing force causes the fingers to be deflected against the punch itself. As the punch moves on the return stroke, the fingers prevent the can from moving with the punch and the can is stripped from the punch.

The biasing force for deflecting the fingers has been provided by a variety of spring devices, most conventionally by the use of an 'O' ring of resilient material, although other biasing devices, for example a continuous helical spring or using hydraulics, are also possible.

A known stripping assembly which uses an O-ring for biasing respective stripping fingers is described in GB-B-2,181,685. The O-ring in this patent encircles the stripping fingers and is compressively trapped between the fingers and an outer opposing part of an annular housing. The O-ring further causes the fingers to rest on seating parts of the housing so as to limit the extent to which the tips of the fingers, which engage the can, protrude from the housing.

Known stripping devices have several drawbacks, particularly when high manufacturing speeds are used. If excessive pressure is used to strip the can during the return stroke, the open end of the can may be spoiled and the punch may even be damaged. During the forward stroke, the coating on the can surface is often scratched as the stripper fingers are forced open by the can carried on the punch. Although the stripping assembly of GB-B-2,181,685 is said to apply only a light pressure to the surface of the can and/or punch, it has nonetheless been found that small scratches are made on the can surface as the stripper fingers are forced open by the can carried on the punch on its forward stroke.

"Active" stripping has been proposed in U.S. Pat. No. 5,115,662 in which one or more electromagnets are energized to move the stripping fingers into or away from the stripping location. This device requires the stripping fingers to be formed from magnetically conductive material and is unsuitable for use with cans which are themselves of magnetically conductive material such as steel since any debris arising from the forming process would be attracted to the electromagnet.

The abstract of JP 2003 103312 shows a stripping device which uses a cam actuation to move the stripping fingers away from the can surface on the forward stroke of the punch. Not only does this device require externally moving parts in the form of the cam and cam followers but it also requires external energizing to move the fingers into the stripping position on the return stroke of the punch.

Although stripping using air pressure alone has been proposed, such devices have not proved practical at high speeds and a mechanical stripper acting on the edge of the can is still required. At high line speeds, the stripper may be used in conjunction with an air strip in which pressurized air passes along the center of the punch to assist in can removal and avoid formation of a vacuum which could cause can collapse.

SUMMARY OF THE INVENTION

According to the present invention, there is provided a stripping assembly for stripping a can from a punch in a can bodymaker, the assembly comprising: a plurality of stripper fingers spaced around an annular housing; and a biasing device for biasing the tips of the fingers radially inwardly from the housing into a central bore of the bodymaker; and an actuator within the housing which, in use, when the punch is carrying a can through the bore on the forward stroke, lifts each finger tip clear of the can carried on the punch, against the action of the biasing device, and when the punch is on the return stroke, is disabled so as to allow the biasing device to cause the finger tips to close and strip the can from the punch; characterizing in that the fingers are resiliently mounted for self-aligning with the cut edge of the can on the return stroke of the punch.

As the top edge of the can is never smooth, this self-alignment prevents the fingers from simply hitting the nearest part of the uneven edge of the can and bending or fracturing it with resultant debris within the bodymaker. Preferably the fingers are resiliently mounted on an 'O'-ring or cord item.

By using an active stripping assembly which lifts the fingers clear of the can on the forward stroke of the punch, damage to the can surface is completely eliminated. The stripping assembly of the present invention is particularly suitable for use with steel cans which are coated or laminated, for example with a polymer. Usually, the actuator comprises a piston operated by fluid pressure.

In a preferred embodiment of the invention, the fingers include a bottom and top portion within the housing, the top portion contacting a lip about which the fingers pivot on the forward stroke as the pivot pushes the bottom of fingers outwards. As the stripper fingers pivot in an arc about the lip, the biasing device is compressed and the fingers are forced open. The biasing device may typically comprise an O-ring or spring, such as a garter spring.

Typically, the actuator piston is situated in an upstream portion and the biasing device (O-ring) in a downstream portion. The actuator may further comprise compressed air or fluid which may be operated by a solenoid and timed by a signal from the bodymaker.

According to another aspect of the present invention, there is provided a method of stripping a can from a punch in a can bodymaker having a stripping assembly with a plurality of fingers and a biasing device for biasing the tips of the fingers into the bore of the bodymaker, the method comprising: enabling the actuator and lifting each finger tip clear of the can carried on the punch against the action of the biasing device when the punch is carrying a can through the bore on the forward stroke; and disabling the actuator when the punch is on the return stroke and allowing the biasing device to close the finger tips to strip the can from the punch; and characterized by enabling the fingers to self-align to the shape of the can on the return stroke of the punch.

A preferred embodiment of the invention will now be described, by way of example only, with reference to the drawings.

DETAILED DESCRIPTION OF THE PREFERRED EMBODIMENTS

Figure 1:
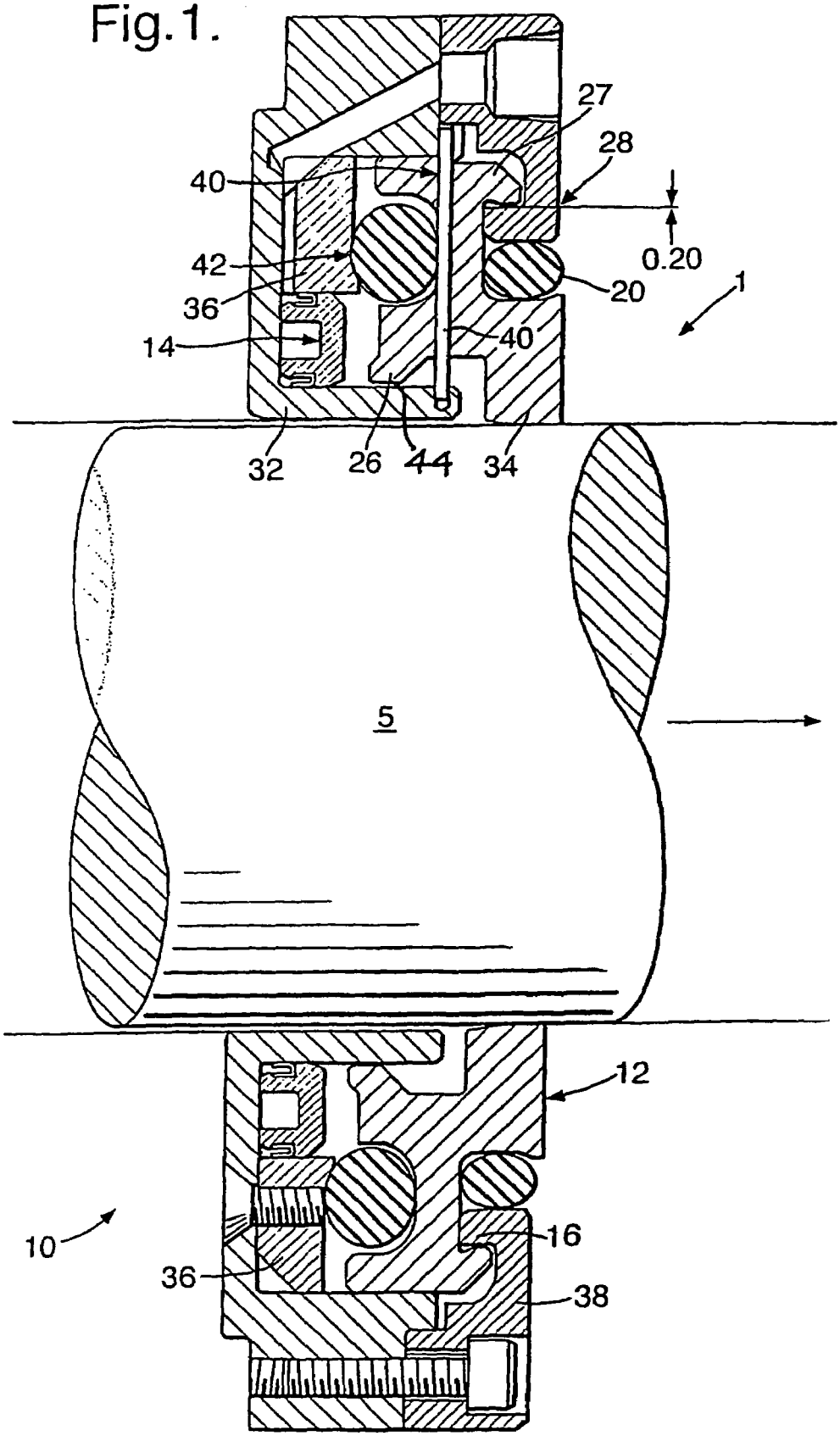
FIG. 1 is a side section of a first embodiment of stripping assembly taken on the section I—I of FIG. 2.

The stripping assembly 10 is shown in the figures in its "at rest" state. The assembly includes a hollow annular housing 32 defining a central bore 5 of the bodymaker 1. During a draw and wall ironing (DWI) operation, a can is carried on the free end of a punch in the direction of the arrow.

The housing 32 comprises a pair of complementary upstream and downstream annular shells 36, 38 which are secured face to face to define an annular chamber. A ring of stripper fingers 12 is disposed within the annular chamber of the housing, the tips 34 of the fingers extending from the housing 32 radially inwards into the bore 5. The fingers 12 include a bottom 26 and top 27 portion within the housing 32. The fingers 12 may be of carbide, ceramic or steel, for example. Carbide fingers avoid scoring of the punch on the return stroke if no lubrication is used as, for example, when the can has a polymer coating which could be affected by some lubricants.

An O-ring 20 is disposed between the downstream shell 38 of the housing and the fingers 12. This O-ring 20 biases each stripper finger 12 radially inwardly into the bore 5. The fingers 12 are separated circumferentially by needle bearings 40 as shown in the top part of FIG. 1 and the portion 30 of FIG. 2 in which a finger has been removed for clarity. A further O-ring or cord item 42 in the upstream shell 36 allows the fingers to conform to the shape of the top edge of the can for stripping. This 'O'-ring 42 enables the fingers to tilt sideways so that the maximum surface area at the tip of each finger is presented to the top edge of the can. This is particularly important since drawing and wall-ironing a can body results in an uneven edge on the can body. By enabling the stripper fingers to rock, the stripper self-aligns according to the shape of the can edge. In prior art strippers, the fingers are kept "square" and not allowed to tilt. Consequently, the fingers hit the nearest part of the edge of the can body, typically resulting in bending or fracturing that part of the edge. The resultant debris can cause damage to can bodies and/or the surface of the punch.

The stripper assembly 10 of the present invention provides a novel method of activating the stripper fingers so that the fingers are moved out of the path of a can which is carried on the punch and passes through the fingers. A piston 14 is disposed in the upstream shell 36 of the housing. The piston 14 is actuated by pressurized air or fluid controlled by a solenoid valve (not shown) which is timed by a signal from the bodymaker 1.

In contrast with known mechanical strippers, the forward stroke of the punch is coupled to the bodymaker timing unit, which triggers a supply of pressurized air/fluid on the forward stroke to the piston.

When pressurized, the piston moves forward (downstream) until it contacts the "bottom" or radially inner portion 26 of the fingers 12. Further forward motion of the piston pushes against the radially inner portion (bottom) of the finger. As the finger is restrained from moving outwardly, the radially outer ("top") portion 27 of the finger pivots about the lip of the downstream shell or retainer cap 38, at contact point 16. Pivoting of the finger in an arc about the lip 16 thus lifts the tip 34 of each finger clear of the incoming punch.

Pivoting of the stripper fingers 12 compresses O-ring 20 and opens the fingers against the biasing force of the O-ring. The gap 28 between the retainer cap 38 and radially outer portion 27 of the fingers is open when the fingers are released by the piston and are in contact with the punch, this ensures positive contact. The gap 28 increases as the fingers pivot forward when the stripper is activated to let the can pass through. The gap is closed by the O-ring as the punch is withdrawn, thus acting as a stop.

At the end of the stroke, when the can has passed beyond the stripper fingers, the solenoid switches off the air/fluid supply to the piston 14 and O-ring 20 pushes the piston back, allowing the fingers 12 to close on the punch for the return stroke. On the return stroke, the stripping fingers are in contact with the punch so that they engage the rear end edge of the can and movement of the can with the punch is resisted. The stripping fingers are allowed to tilt due to being resiliently mounted on 'O'-ring 42. This self-alignment prevents fracture of the uneven edge of the can. The can is then separated from the punch in conventional manner.

Figure 3:
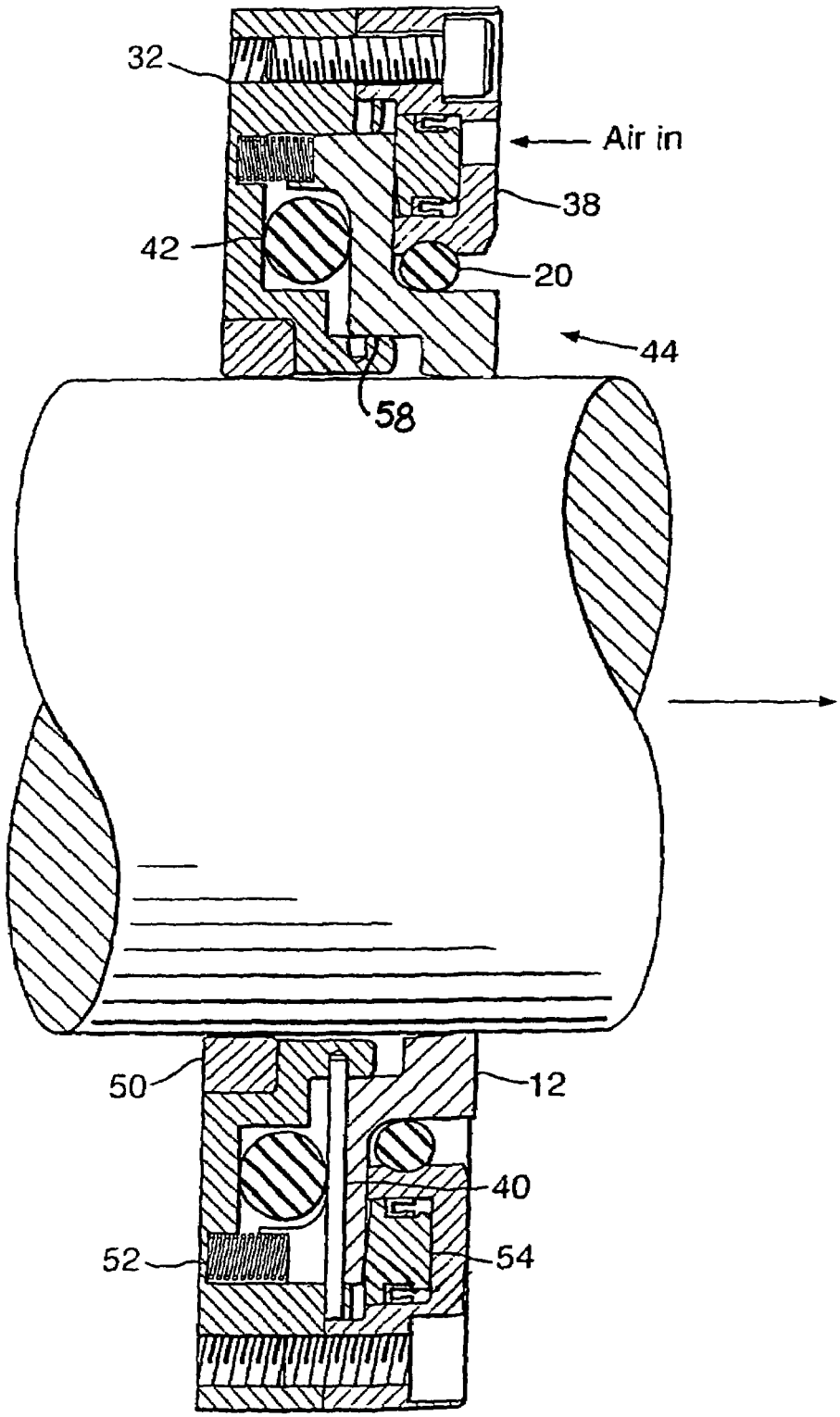
FIG. 3 is a side section of a second embodiment of stripping assembly.

In the alternative embodiment of FIG. 3, the piston is situated at the front (downstream side) of the finger and a guide ring 50 is included in the rear (upstream side) of the stripper body 32.

In this embodiment, when the punch is removed, the O-ring 20 closes the gap 44 (typically 0.2 mm) and holds the finger 12 against the stripper body. When air is applied (in the direction shown by the arrow in FIG. 3) the piston 54 located in the retainer cap 38 moves outwards and the fingers 12 rock backwards pivoting around the contact point 58 against the stripper body. This causes the tips of the stripper fingers to lift clear of the incoming punch.

Figure 2:
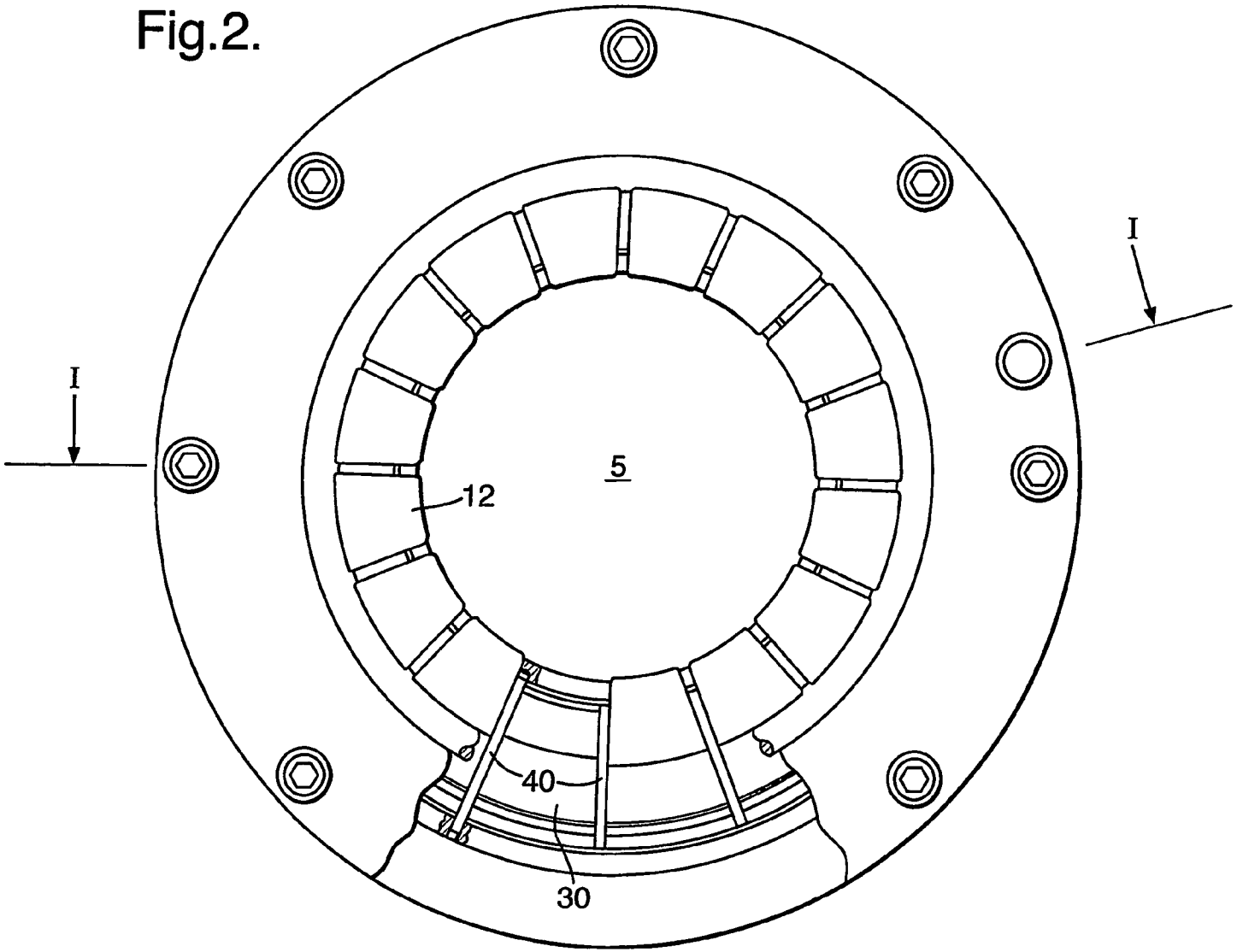
FIG. 2 is a front view of the stripping assembly of FIG. 1.

Air is supplied in the same way as in the embodiment of FIG. 1, via a solenoid actuated from an electrical signal from the bodymaker. The finger 12 has a chamfer behind the pivot point 58 to allow it to rock backwards.

When the air is turned off the O-ring 20 closes the fingers against the punch. Springs 52 increase the speed at which the fingers close. O-ring 42 allows the fingers to conform to the shape of the top edge of the can as in the first embodiment. There are sixteen segments as in the first embodiment and these are separated with the similar pins 40.

Guide ring 50 limits oscillation of the punch as it leaves the last ironing die. The punch will then contact the dome station more centrally and help to reduce the occurrence of split domes. The guide ring 50 also guides the back edge of the punch to keep it more central at the point of stripping. Ring 50 can be made from a number of materials which are selected so as not to mark the can on the punch, depending on the material from which the can (and/or its coating) is made. The ring can also be extended back into the stripper housing void if required to prevent build up of debris.

Although a preferred embodiment of the invention has been specifically illustrated and described herein, it is to be understood that minor variations may be made in the apparatus without departing from the spirit and scope of the invention, as defined by the appended claims.

What is claimed is:

1. A stripping assembly (10) for stripping a can from a punch in a can bodymaker (1), the assembly (10) comprising:

a plurality of stripper fingers (12) spaced around an annular housing (32);

a resilient O-ring (20) for biasing the tips (34) of the fingers (12) radially inwardly from the housing (32) into a central bore (5) of the bodymaker (1);

a piston (14, 54) within the housing (32) which, in use, when the punch is carrying a can through the bore on the forward stroke, lifts each finger tip (34) clear of the can carried on the punch, against the action of the resilient O-ring (20), and when the punch is on the return stroke, is disabled so as to allow the resilient O-ring (20) to cause the finger tips (34) to close and strip the can from the punch; and the fingers (12) being mounted upon a resilient O-ring (42) for self-aligning with the cut edge of the can on the return stroke of the punch.

2. The stripping assembly according to claim 1, in which the fingers (12) include an inner portion (26) and an outer portion (27) within the housing, and the outer portion (27) contacts a lip (16) about which the fingers (12) pivot on the forward stroke as the piston (14) pushes the inner portion (26) of the fingers (12).

3. The stripping assembly according to claim 1, in which the piston (14) is situated in an upstream portion and the resilient O-ring (20) in a downstream portion or the stripping assembly.

4. The stripping assembly according to claim 1, in which the fingers (12) include an inner portion and an outer portion within the housing, and the inner portion contacts a point (58) about which the fingers (12) pivot on the forward stroke as the piston (54) pushes the outer portion of the fingers (12).

5. The stripping assembly according to claim 4, in which the piston (54) is situated in a downstream portion of the stripping assembly.

6. The stripping assembly according to claim 4, further including a guide ring 50.

7. The stripping assembly according to claim 1, in which the piston (14) is actuated by one of compressed air and fluid.

8. The stripping assembly according to claim 7, in which one of compressed air and fluid flow is operated by a solenoid which is timed by a signal from the bodymaker (1).

* * * * *